US007003921B2

(12) United States Patent
Hisano

(10) Patent No.: US 7,003,921 B2
(45) Date of Patent: Feb. 28, 2006

(54) EXPANSION JOINT AND REINFORCEMENT CONNECTION METHOD USING THE EXPANSION JOINT

(75) Inventor: Toshifumi Hisano, Kumamoto (JP)

(73) Assignee: Yamax Corp., Kumamoto (JP)

( * ) Notice: Subject to any disclaimer, the term of this patent is extended or adjusted under 35 U.S.C. 154(b) by 103 days.

(21) Appl. No.: 10/381,804

(22) PCT Filed: Oct. 23, 2001

(86) PCT No.: PCT/JP01/09280

§ 371 (c)(1),
(2), (4) Date: Mar. 28, 2003

(87) PCT Pub. No.: WO02/36900

PCT Pub. Date: May 10, 2002

(65) Prior Publication Data

US 2004/0018045 A1 Jan. 29, 2004

(30) Foreign Application Priority Data

Oct. 30, 2000 (JP) ..... 2000-330457

(51) Int. Cl.
*E04C 5/08* (2006.01)

(52) U.S. Cl. ..... 52/223.9; 52/223.11; 52/223.14; 52/583.1

(58) Field of Classification Search ..... 52/223.6, 52/223.7, 223.9, 223.11, 223.14, 223.13, 52/231, 583.1; 403/267
See application file for complete search history.

(56) References Cited

U.S. PATENT DOCUMENTS 3,999,355 A * 12/1976 Stucky ..... 52/745.03

(Continued)

FOREIGN PATENT DOCUMENTS

JP 58-222249 A 12/1983

(Continued)

*Primary Examiner*—Carl D. Friedman
*Assistant Examiner*—Chi Q. Nguyen
(74) *Attorney, Agent, or Firm*—McDermott Will & Emery LLP

(57) ABSTRACT

An expansive filler joint includes:

a securing hollow body (1) embedded in a jointing end (3, 3) of forming concrete (K) or concrete segmental products (K', K'), the securing hollow body (1) made of a rigid material and having a closure means (2) disposed at a plurality of side ends of the securing hollow body (1), an expansive filler (4) filling the securing hollow body (1), and reinforcing bars (5, 5) inserted into the securing hollow body through the closure means (2) and opposed to each other, wherein the opposed reinforcing bars (5, 5) are secured by prestress and pressure of expansion of the filler (4).

A reinforcing bar jointing process includes:

embedding a securing hollow body (1) in a jointing end (3, 3) of forming concrete (K) or concrete segmental products (K', K'), the securing hollow body (1) made of a rigid material, providing a closure means (2) disposed on an opening (1*a*) formed at a side end of the securing hollow body (1), filling an expansive filler (4) into the securing hollow body (1) through the closure means (2), and inserting at least one of reinforcing bars (5, 5) opposed to each other into the securing hollow body (1) through the closure means (2), wherein the reinforcing bars (5, 5) are secured to each other by prestress and pressure of expansion of the filler (4).

9 Claims, 6 Drawing Sheets

U.S. PATENT DOCUMENTS 4,331,254 A * 5/1982 Haggerty ..... 220/229
4,627,212 A * 12/1986 Yee ..... 52/726.1
4,666,326 A * 5/1987 Hope ..... 403/13
4,808,031 A * 2/1989 Baker ..... 405/168.1
5,106,163 A * 4/1992 Fujiwara et al. ..... 299/1.3
5,974,761 A * 11/1999 Mochizuki et al. ..... 52/740.1
6,151,850 A * 11/2000 Sorkin ..... 52/223.13
6,216,403 B1 * 4/2001 Belbeoc'h ..... 52/223.13
6,620,487 B1 * 9/2003 Tonyan et al. ..... 428/192
6,752,435 B1 * 6/2004 Sorkin ..... 285/230
2002/0157333 A1 * 10/2002 Kadotani et al. ..... 52/223.2
2003/0159395 A1 * 8/2003 Dahl ..... 52/726.1

FOREIGN PATENT DOCUMENTS

JP 2-145680 A 6/1990
JP 468142 * 3/1992
JP 6-299656 A 10/1994
JP 8-151735 A 6/1996

* cited by examiner

EXPANSION JOINT AND REINFORCEMENT CONNECTION METHOD USING THE EXPANSION JOINT

TECHNICAL FIELD OF THE INVENTION

The present invention relates to an expansive filler joint and a reinforcing bar jointing process utilizing the expansive filler joint. The process is applied to secure a jointing end in reinforced concrete or a concrete segmental product which is used in a building site of civil engineering and building works. The jointing end has an imbedded reinforcing bar (steel) that is inserted into a securing hollow body. The securing hollow body is filled with an expanding agent which expands against a sounding inner surface, so that a reaction force of the expanding agent, which generate prestress and pressure, secures the reinforcing bar in the securing hollow body.

BACKGROUND ART

Conventionally, a process of jointing reinforcing bars imbedded in concrete of a reinforced concrete construction uses, for example, joints which are joined to each other by welding or the like. Another is a lap joint process utilizing metal wires which are wound around a lapped portion of ends of the reinforcing bars for jointing thereof.

A further another jointing process uses threaded joints, in which threads are provided in ends of reinforcing bars. A further another jointing process uses a mortar joint for jointing reinforcing bars to each other by a bond performance of a mortar which is filled to surround the reinforcing bars.

The conventional jointing process for jointing the reinforcing bars by welding requires a lot of time and efforts for welding the reinforcing bars to each other in a construction site, and a special welding technique is necessary for the welding, causing an inefficient working step. The lap jointing process in which a metal wire is wound around a lapped portion of opposed reinforcing bars requires a lot of time and efforts to wind the metal wire around the lapped portion. The screw joint having a threaded portion at a jointing end of a reinforcing bar also requires a lot of time and efforts for forming a thread on a reinforcing bar to join opposed steel bars to each other, causing an inefficient working step.

Furthermore, the mortar jointing process depends on a bonding strength between the reinforcing bar and the concrete to join a pair of opposed reinforcing bars to each other. Therefore, the reinforcing bars should have a lapping length to join each other. The mortar jointing process can not provide a sufficient bonding strength of the mortar for securing the reinforcing bars due to incorrect compounding ratios or mixing processes of composing materials. In the case of jointing reinforcing bars of concrete segmental products, end portions of the concrete segmental products are joined to each other, before the mortal of a securing material is supplied to the jointing portion of the concrete segmental products. Moreover, a worker can not see the mortal filled into the concrete segmental products to confirm a securing state thereof.

To eliminate the disadvantages of the conventional arts, the present invention provides an expansive filler joint and a reinforcing bar jointing process utilizing the expansive filler joint. The reinforcing bar jointing process allows efficient jointing of reinforcing bars without a lot of time and efforts and provides a sufficient bonding strength to firmly join the reinforcing bars with a shirt lapping length of the reinforcing bars. Furthermore, a filling state of the expanding agent can be easily seen in the case of jointing ends of concrete segmental products, and the expansive filler joint is simple in structure, allowing a low manufacturing and material cost.

DISCLOSURE OF THE INVENTION

An expansive filler joint according to the present invention includes:

- a securing hollow body embedded in a jointing end of forming concrete or concrete segmental products, the securing hollow body made of a rigid material and having a closure means disposed at a plurality of side ends of the securing hollow body,
- an expansive filler filling the securing hollow body, and
- reinforcing bars inserted into the securing hollow body through the closure means and opposed to each other , wherein the opposed reinforcing bars are secured by prestress and pressure of expansion of the filler.

The present invention is also characterized in that the securing hollow body is defined in a straight pipe sleeve or an L-shaped tubular body, a tubular body having three or four end openings, a box, or a generally ball-shape body.

The present invention is also characterized in that the securing hollow body has a thickness of about 3 to 15 mm.

The present invention is also characterized in that the securing hollow body has an outer surface contacting surrounding concrete and provided partially or totally with a membrane layer made of a flexible material.

The present invention is also characterized in that the filer includes calcium oxide of about 80.0 to 84.0 weight % as a major constituent, a heat generation retardant of about 1.0 to 2.0 weight %, silicon dioxide of about 8.0 to 9.0 weight %, aluminum oxide of about 2.0 to 2.3 weight %, and sulfur trioxide of about 4.0 to 4.5 weight %.

The present invention is also characterized in that the closure means is a synthetic resin cap for closing an opening formed at a side end of the securing hollow body, and the cap may have a filling hole for introducing a filler.

The present invention is also characterized in that the cap of the closure means is provided with a suitable number of radially extending slits, and the filing hole is positioned near an upper periphery of the cap. The present invention is also characterized in that the closure means has a generally annular sealing plate positioned in its rear side, the sealing plate being resilient for press-contacting an outer circumferential surface of a reinforcing bar inserted into the securing hollow body.

A reinforcing bar jointing process according to the present invention includes:

- embedding a securing hollow body in a jointing end of forming concrete or concrete segmental products, the securing hollow body made of a rigid material
- providing a closure means disposed on an opening formed at a side end of the securing hollow body,
- filling an expansive filler into the securing hollow body through the closure means, and
- inserting at least one of reinforcing bars opposed to each other into the securing hollow body through the closure means,
- wherein the reinforcing bars are secured to each other by prestress and pressure of expansion of the filler.

BRIEF DESCRIPTION OF THE ACCOMPANIED DRAWINGS

BEST MODE EMBODYING THE INVENTION

Figure 1:
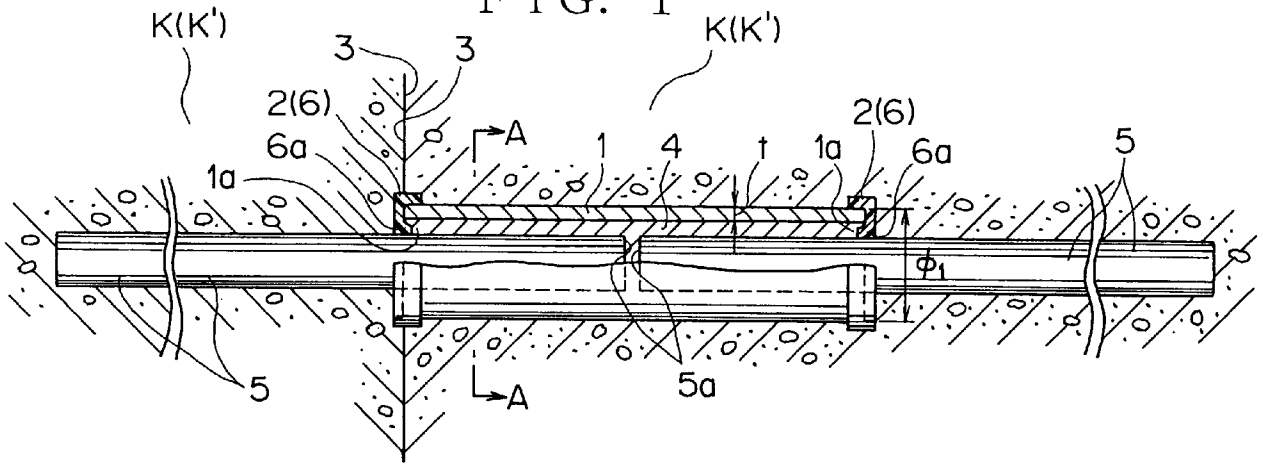
FIG. 1 is a partial sectional side view showing a first embodiment of an expansive filler joint according to the present invention, which illustrates reinforcing bars joined to each other.

Referring to the accompanied drawings, embodiments of the present invention will be discussed hereinafter.

Referring to FIGS. 1 to 6, a first embodiment of an expansive filler joint according to the present invention will be discussed. Reference numeral 1 designates a securing hollow body having closing means 2, 2 each positioned at a side end thereof. The securing hollow body is defined in a straight sleeve opened at each end thereof. The securing hollow body 1 is embedded in one of jointing ends 3, 3 of forming concrete K or segmental concrete products K'. For example, the securing hollow body 1 is formed from a steel member and has a diameter $\phi 1$ of about 30 to 80 mm and a thickness t of about 3 to 15 mm.

Reference numeral 4 designates an expansive filler filling the securing hollow body 1. Prestress and pressure provided by the filler 4 join end portions 5*a*, 5*a* of reinforcing bars 5, 5 inserted into the securing hollow body 1 through the closing means 2, 2.

The filler 4 used in the embodiment has, for example, a composition shown in Table 1.

TABLE 1

| Components | Weight % |
|---|---|
| heat generation retardant | 1.0 to 2.0 |
| silicon dioxide | 8.0 to 9.0 |
| aluminum oxide | 2.0 to 2.3 |
| ferric oxide | 0.9 to 1.3 |
| calcium oxide | 80.0 to 84.0 |
| magnesium oxide | 0.4 to 0.6 |
| sulfur trioxide | 4.0 to 4.5 |
| Total | 100 |

Figure 4:
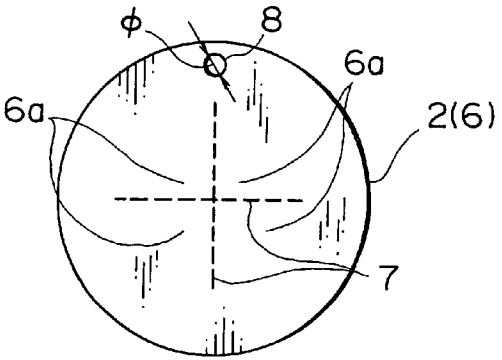
FIG. 4 is an enlarged front view showing an example of the closure means of the embodiment.
Figure 2:
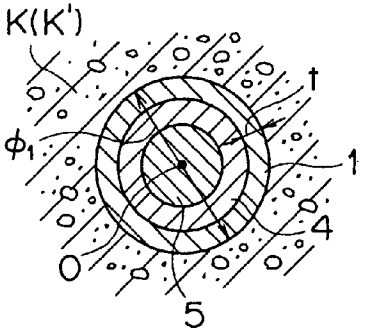
FIG. 2 is a sectional view taken along line A—A of FIG. 1.
Figure 3:
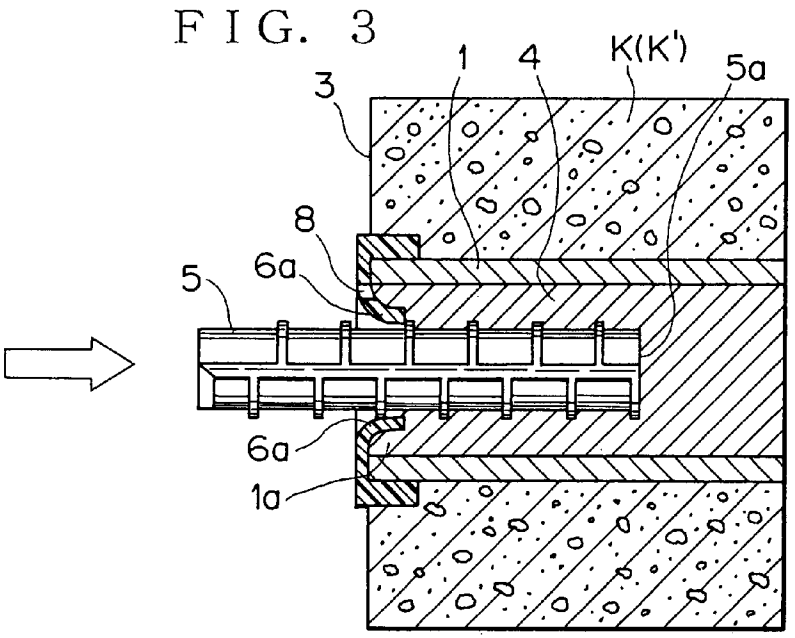
FIG. 3 is an enlarged sectional view showing a state in which a reinforcing bar is inserted through a closure means into a securing hollow body filled with a filler.

As shown in Table 1, the filler 4 employed in the embodiment includes, calcium oxide of about 80.0 to 84.0% as a major constituent which takes a large part of the filler 4, a heat generation retardant of about 1.0 to 2.0%, silicon dioxide of about 8.0 to 9.0% as an admixture, and aluminum oxide of about 2.0 to 2.3 in weight as an expansion adjuvant for the calcium oxide. The filler 4 includes calcium oxide of 80.0 to 84.0% in weight, and the aluminum oxide of 2.0 to 2.3% in weight enhances a quick, smooth hydration reaction. Thereby, the expanding agent expands quickly surely within a short time in the securing hollow body 1 to secure reinforcing bars 5, 5 inserted into the securing hollow body 1. The calcium oxide fills void spaces of the securing hollow body 1 so that the filler 4 increase solidity, strength, and compression stress of the construction. As illustrated in FIG. 4, the securing hollow body 1 has closing means 2, 2 for closing openings 1*a*, 1*a* each facing a direction different from each other, and the closing means 2, 2 each are a cap 6 made of a synthetic resin material and coupled to each of the openings 1*a*, 1*a*. The cap 6 has a circular front face and is formed with a desired number of, e.g., four as illustrated in FIG. 4, radial slits 7. The slits 7 define several, four in FIG. 4, divided pieces 6*a* dividing the cap 6. Through the divided pieces 6*a*, end portions 5*a*, 5*a* of the reinforcing bars 5, 5 are pushed into the securing hollow body 1. A filling hole 8 is provided at a point outward from the slit 7 for supplying the filler 4 in the securing hollow body 1. The filling hole 8 has a hole diameter $\phi$, and the number of the holes are determined appropriately.

The filler 4 is easily filled into the securing hollow body 1 through the filling hole 8 by means of a filling attachment (not shown) such as a funnel tube receiving the filler 4 without using a special pumping unit.

The first embodiment having the aforementioned configuration according to the present invention joins the end portions 5*a*, 5*a* of the reinforcing bars 5, 5 embedded in forming concrete K at a construction site or in a segmental concrete product K' formed in a fabrication factory. First in this process, as illustrated in FIG. 1, the securing hollow body 1 is embedded in at least one of jointing ends 3, 3 of the forming concrete K or the segmental concrete products K', K'. The securing hollow body 1 is made of a rigid material like steel and is a sleeve of a straight pipe having openings 1*a*, 1*a* each facing a different side.

Next, as illustrated in FIG. 1, the cap 6 of a closing means 2 closes each side face of the securing hollow body 1 made of a rigid material, that is, the cap 6 closes each of openings 1*a*, 1*a* positioned at a jointing end 3 of the forming concrete K or at one of the segmental concrete products K'.

Then, at least one of reinforcing bars 5 is inserted into the securing hollow body 1 through the cap 6 of the closure means 2 at one of the jointing ends 3, 3. The insertion is carried out before the forming concrete K becomes complete in curing and solidification or before the segmental concrete products K', K' finally join to each other. An end portion 5*a* of the reinforcing bar 5 is positioned to be opposed to an end portions 5*a* of another reinforcing bar 5 inserted into the securing hollow body 1 from another side thereof. The cap 6 closing the opening la of the securing hollow body 1 has the several radial slits 7 which are four in FIG. 4 to define four divided pieces 6*a*. The divided pieces 6*a* resiliently spread by pressure due to insertion of the reinforcing bar 5, so that the reinforcing bar 5 is smoothly surely inserted into the securing hollow body 1.

Then, the filler 4 is filled through the filling hole 8 formed in the cap 6 into the securing hollow body 1 by applying the funnel tube attachment (not shown). Thereby, the reinforcing bars 5, 5 inserted into the securing hollow body 1 are secured firmly by prestress and pressure produced by a large expansion pressure of the filler 4 to increase a bonding strength thereof, because the expansion of the filler 4 is restricted by a peripheral wall of the securing hollow body 1.

The resilient reaction force of the divided pieces 6*a* which is four in FIG. 4 closes the securing hollow body 1 filled with the filler 4, so that no clearance is defined between the cap 6 and the reinforcing bar 5 inserted in to the securing hollow body 1 through the divided pieces 6*a*. This prevents the filler from unintentionally leaking externally out of the securing hollow body 1.

Figure 5:
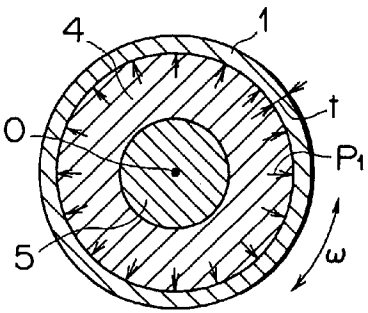
FIG. 5 is a sectional view showing a state in which the filler provides an expansion pressure P1 acting in radial directions of the securing hollow body to achieve a pressure effect.

The filler 4 expands in the securing hollow body 1 so that, for example, as illustrated in FIG. 5, an expansion pressure P1 oriented toward a periphery from a center ω of the securing hollow body 1 provides a strain ω in a peripheral direction of the securing hollow body 1. A larger thickness t of the securing hollow body 1 made of steel provides a smaller strain ω of the securing hollow body 1 due to expansion pressure of the filler 4. A further larger thickness t of the securing hollow body 1 provides a strain ω of almost zero. Thus, the securing hollow body 1 restricts the expansion of the filler 4, so that almost all of the expansion energy of the filler 4 serves to consolidate the filler 4, providing a press effect (consolidation effect).

The tube-type securing hollow body 1 preferably has a smaller diameter ϕ1 when the securing hollow body 1 has a larger t to obtain a larger expansion pressure of the filler 4 for the press effect. This ensures a fast construction of the forming concrete K or the segmental concrete product K' with a sufficient jointing length of the reinforcing bars 5, 5 inserted into the securing hollow body 1.

Figure 6:
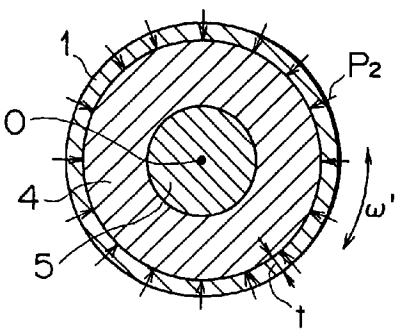
FIG. 6 is a sectional view showing a state in which the securing hollow body provides a compression pressure P2 acting on the filler in radial directions of the securing hollow body to achieve a prestress effect.

On the contrary, a smaller t of the securing hollow body 1 provides a larger strain ω' of the securing hollow body 1 by the expansion pressure of the filler 4. A further smaller t of the securing hollow body 1 can not achieve a sufficient rigidity of the securing hollow body 1, so that the securing hollow body 1 deforms unstably and the expansion pressure of the filler 4 becomes almost zero. Normally, almost all of the expansion energy of the filler 4 provides a strain ω' of the securing hollow body 1 made of steel. As illustrated in FIG. 6, a compressive pressure P2 oriented toward the center ω of the securing hollow body 1 acts on the filler 4 to provide a press effect, while the P2 corresponds to the strain ω'. A different t of the securing hollow body 1 made of a rigid steel material provides a different pressure (prestress) effect, achieving a different securing strength of the expansive filler joint for the reinforcing bars 5, 5 to considerably change a jointing performance thereof. To obtain a best jointing performance, the securing hollow body 1 of the embodiment has a thickness t of 3 to 15 mm, which efficiently provides a pressure (prestress) effect.

In the jointingprocess of the embodiment, the filler 4 expands in the securing hollow body 1 made of a rigid material to provide a prestress effect and a pressure effect (consolidation effect). Thus, the filler 4 increases a bonding strength for the reinforcing bars 5, 5, so that the reinforcing bars 5, 5 opposed to each other are firmly secured in the forming concrete K or the segmental concrete product K'. Accordingly, the reinforcing bars 5, 5 require a shorter securing length.

The expansive filler joint of the embodiment surely provides a sufficient bonding strength unlike a conventional mortar jointing process depending on mixing ratios and mixing processes of materials to define the forming concrete K or the segmental concrete product K' in a construction site. The expansive filler joint of the embodiment can secure the reinforcing bars 5, 5 even under a comparatively difficult construction environment by expansion pressure of the filler 4 confined in the securing hollow body 1 made of a rigid member, providing a structural joint having a stable strength.

In the expansive filler joint of the embodiment, the straight tube securing hollow body 1 made of rigid member has the opening 1*a* at each longitudinal end thereof, and each opening 1*a* is closed by the cap 6 of the closing means 2 to surely prevent the filler 4 from leaking out of the securing hollow body 1. Furthermore, the securing hollow body 1 is filled with the filler 4 before placing of forming concrete K in a fabrication site or before jointing of the segmental concrete products K', K'. The securing hollow body 1 is embedded in a jointing end 3 of one of the segmental concrete products K', K', and the cap 6 of the securing hollow body 1, which is positioned in the side of the jointing end 3, has a filling hole 8 through which the filler 4 is supplied while a filled quantity can be surely monitored during the filling process. Thus, the expansion pressure of the filler 4 effectively fixes the reinforcing bars 5, 5 surely to join each other to define a firm structure.

(Specified Embodiments)

The securing hollow body 1 is a straight sleeve made of steel which has a diameter ϕ1 of about 40 mm and a thickness t of 10 mm. The securing hollow body 1 has two openings 1*a*, 1*a* closed by synthetic-resin caps 6, 6 of closure means and is embedded in one of jointing ends 3, 3 of forming concrete K, K at a construction site. Each cap 6 has radial slits 7 to define divided pieces 6*a*, and the reinforcing bars 5, 5 opposed to each other are axially inserted into the securing hollow body 1 against the resiliency of the divided pieces 6*a*. Then, the filler 4 is filled into the securing hollow body 1 through the filling hole 8 of one of the caps 6, 6. The filler 4 includes calcium oxide of about 82.5%, a heat generation retardant of about 1.1%, silicon dioxide of about 8.3%, aluminum oxide of about 2.1%, and sulfur trioxide of 4.3% in weight. The filler 4 expands in the securing hollow body 1 to provide prestress and pressure so that the filler 4 can fix the reinforcing bars 5, 5 having the opposed end portions 5*a*, 5*a* in the securing hollow body 1. Actually, this achieved a high consolidation, a high strength, and a high compressed structure in the securing hollow body 1 to increase a bonding strength of the filler 4 to the reinforcing bars 5, 5. A test method of the strength was subject to JIS (Japanese Industrial Standard) R 5202.

Figure 7:
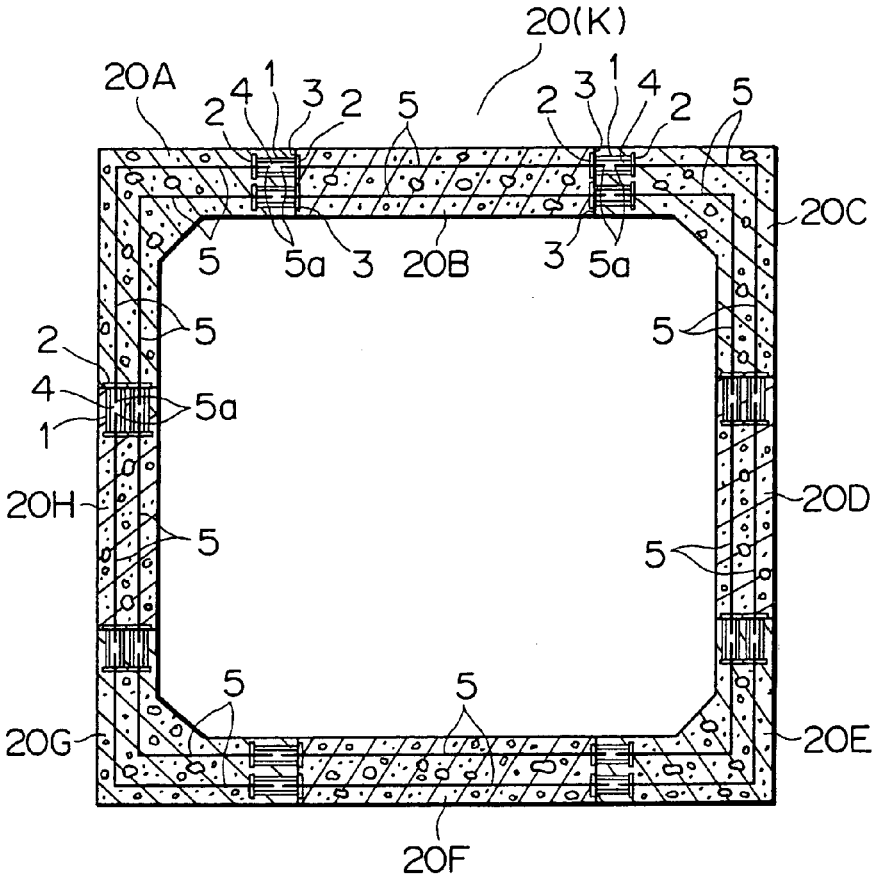
FIG. 7 is a sectional view showing a state in which an expansive filler joint according to the present invention is applied to a large L-shaped box culvert.

As illustrated in FIG. 7, a large-scale culvert 20 is a specified example of a segmental concrete product K' employing an expansive filler joint and a jointing process such as described above.

The culvert 20 consists of several segmental blocks 20A, 20B, 20C, 20D, 20E, 20F, 20G, and 20H, each of which is light in weight and small in volume. The segment allows easy fabrication and storage of the culvert 20 in a factory and is better in transportation and transfer to a fabrication site. At the fabrication site, the segmental blocks 20A, 20B, 20C, 20D, 20E, 20F, 20G, and 20H are easily reliably assembled one after another to enable efficient erection thereof.

Figure 8:
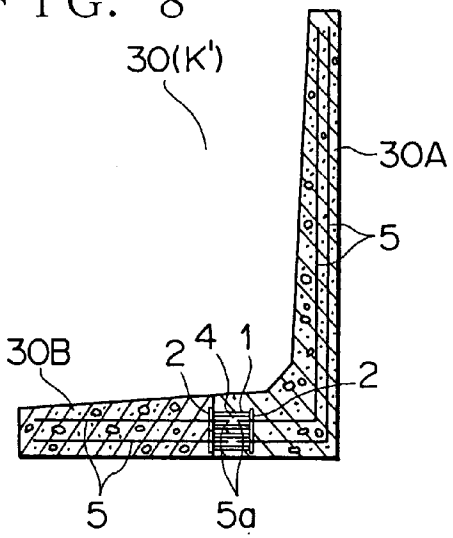
FIG. 8 is a sectional view showing an example in which an expansive filler joint according to the present invention is applied to a large L-shaped bulkhead block.
Figure 9:
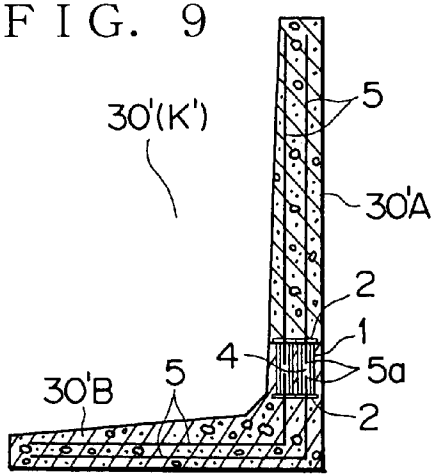
FIG. 9 is a sectional view showing another example in which an expansive filler joint according to the present invention is applied to a large L-shaped bulkhead block.

FIGS. 8 and 9 show another example of a segmental concrete product K' employing an expansive filler joint and a jointing process according to the present invention.

11

In this example, a large-scale L-shaped bulkhead block 30 or 30' is divided in segmental blocks 30A, 30B or 30' A, 30' B which are light in weight and small in volume. The division allows easy fabrication and storage of the bulkhead block 30 or 30' in a factory and is better in transportation and transfer to a fabrication site. Furthermore, the segments can be assembled with ease.

Figure 10:
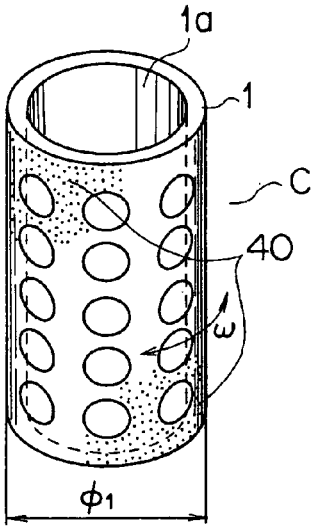
FIG. 10 is a perspective view showing a second embodiment of a securing hollow body according to the present invention, which has a surface partially coated with a membrane layer made of a flexible material.
Figure 11:
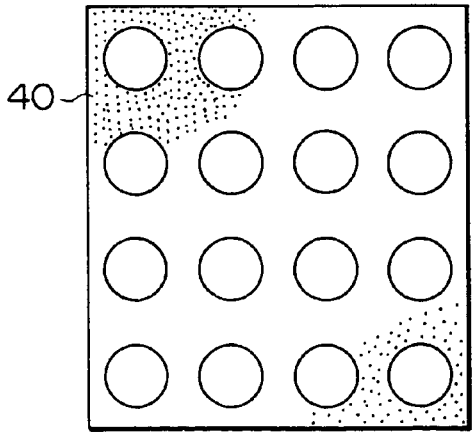
FIG. 11 is a front view showing an example a protrusion pattern of the membrane layer.

FIGS. 10 and 11 show a second embodiment of an expansive filler joint according to the present invention.

In this embodiment, a securing hollow body 1 has a membrane layer 40 on its outer surface. The membrane layer 40 can contact concrete supplied to surround the securing hollow body 1. The membrane layer 40 is made of a flexible material and has a suitable shape with an appropriate surface pattern provided totally (not shown) or partially as illustrated in FIGS. 10 and 11. The membrane layer 40 prevents cracking of the surrounding concrete C due to the expansion, strain ω, and tensile stress of the securing hollow body 1 which are provided by the expansion pressure of the filler 4 confined in the securing hollow body 1. The membrane layer 40 improves a bonding strength of the securing hollow body 1 to the concrete C. The other configurations and operational effects of the second embodiment are the same as those of the first embodiment.

The securing hollow body 1 of the embodiment has a diameter ϕ1 of about 40 mm, and the membrane layer 40 formed on the outer surface of the securing hollow body 1 has a thickness of about 0.02 to 2.0 mm. The flexible material composing the membrane layer 40 is a resin of vinyl chloride, polyurethane, polypropylene, polystyrene, or polyethylene, a rubber, or the like.

Figure 12:
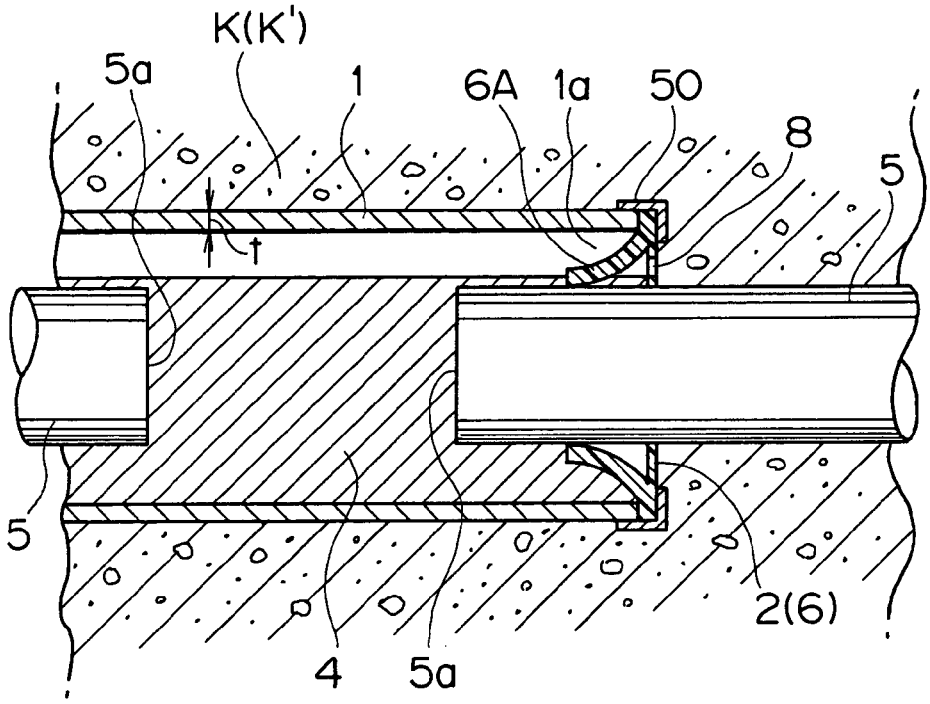
FIG. 12 is a sectional view showing a third embodiment of an expansive filler joint according to the present invention.
Figure 13:
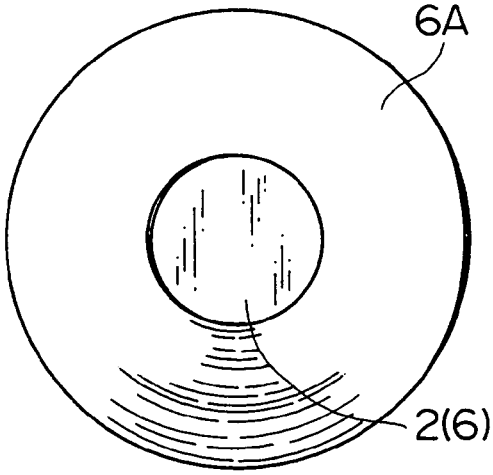
FIG. 13 is a rear view showing another example of a closure means constituting the third embodiment.
Figure 14:
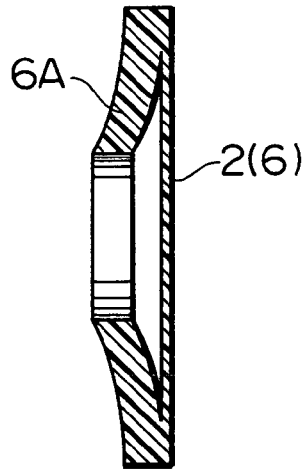
FIG. 14 is a sectional view showing the closure means of FIG. 13.

FIGS. 12 to 14 show a third embodiment of an expansive filler joint according to the present invention.

In the third embodiment, a securing hollow body 1 has an opening 1*a* at a side end thereof and the opening 1*a* is closed by a synthetic-resin cap 6 through which a filling hole 8 is formed. From the filling hole 8, the filler 4 is supplied into the securing hollow body 1. The filler 4 confined in the securing hollow body 1 provides pre-stress and pressure to fix a reinforcing bar 5 inserted into the securing hollow body 1 via the closing means 2, which is the same configuration with the same operational effects as the first embodiment of the present invention shown in FIGS. 1 to 6. However, in the third embodiment, the closing means 2 has a sealing plate 6A of a generally annular shape. The sealing plate 6A is disposed behind the cap 6 of a thin thickness and is secured to a periphery of the cap 6. The sealing plate 6A contacts an outer circumferential surface of the reinforcing bar 5 inserted into the securing hollow body 1.

The filling hole 8 of the cap 6 is formed by drilling the cap 6 with a sharp tip of a rod tool such as a drill and a driver in a construction site, and, through a funnel tube injection tool (not shown) coupled to the filling hole 8, the filler 4 is supplied into the securing hollow body 1. Then, the reinforcing bar 5 breaks the thin cap 6 to enter the securing hollow body 1, so that the insertion force of the reinforcing bar 5 pushes inward and spreads the annular sealing plate 6A disposed behind the cap 6. The resiliency of the sealing plate 6A resists against the insertion force of the reinforcing bar 5 so that the sealing plate 6A press-contacts an outer surface of the reinforcing bar 5. Thus, the sealing plate 6A works like a check valve to surely prevent external leak of the filler 4. Via the closing means 2, the filler 4 is supplied into the securing hollow body 1, and the prestress and pressure due to expansion of the filler 4 fixes the reinforcing bar 5 inserted into the securing hollow body 1. The sealing process of the third embodiment is different from the first embodiment. In FIG. 12, reference numeral 50 designates a metal outer ring coupled to an outer peripheral end of the opening 1*a* of the securing hollow body 1 for fitting the closing means 2 on the opening 1*a* of the securing hollow body 1.

Figure 17:
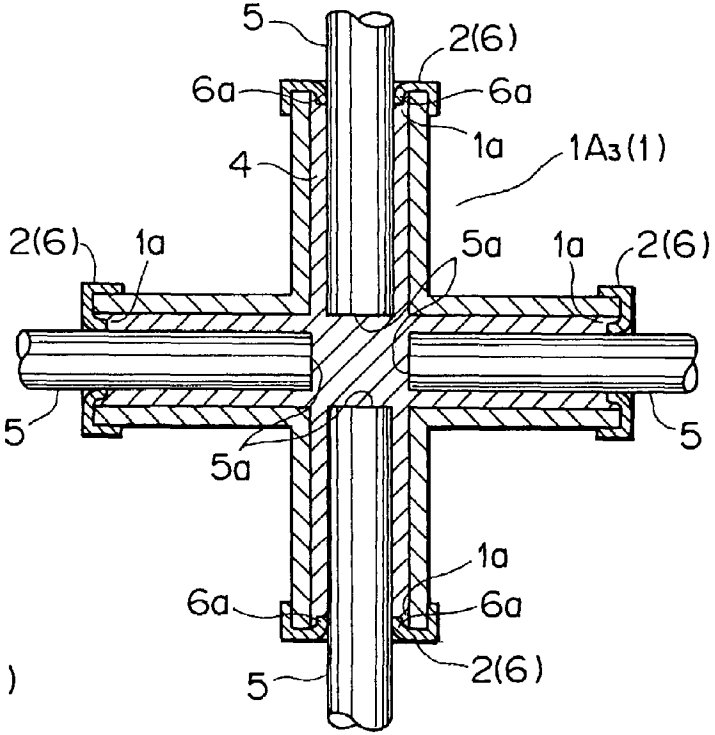
FIG. 17 is a sectional view showing a fourth modified expansive filler joint according to the present invention.
Figure 16:
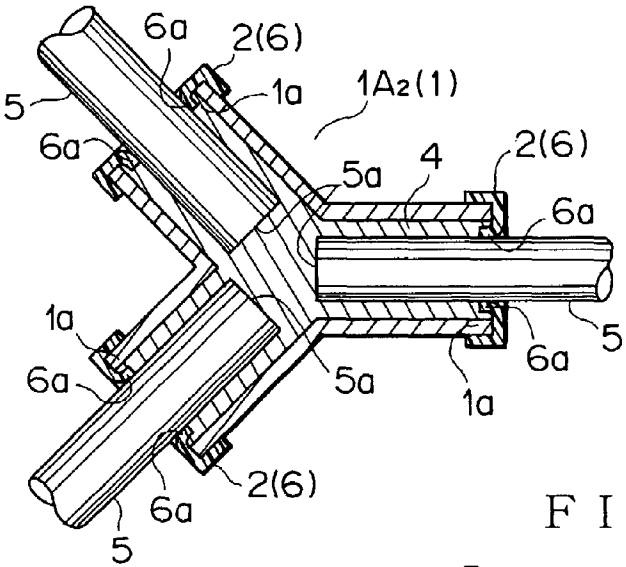
FIG. 16 is a sectional view showing a third modified expansive filler joint according to the present invention.
Figure 15:
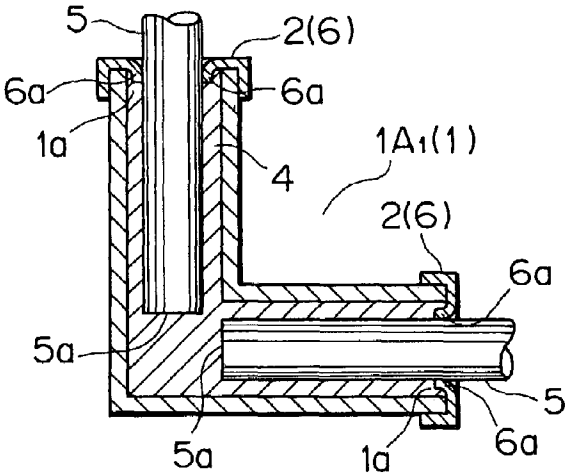
FIG. 15 is a sectional view showing a second modified expansive filler joint according to the present invention.
Figure 18:
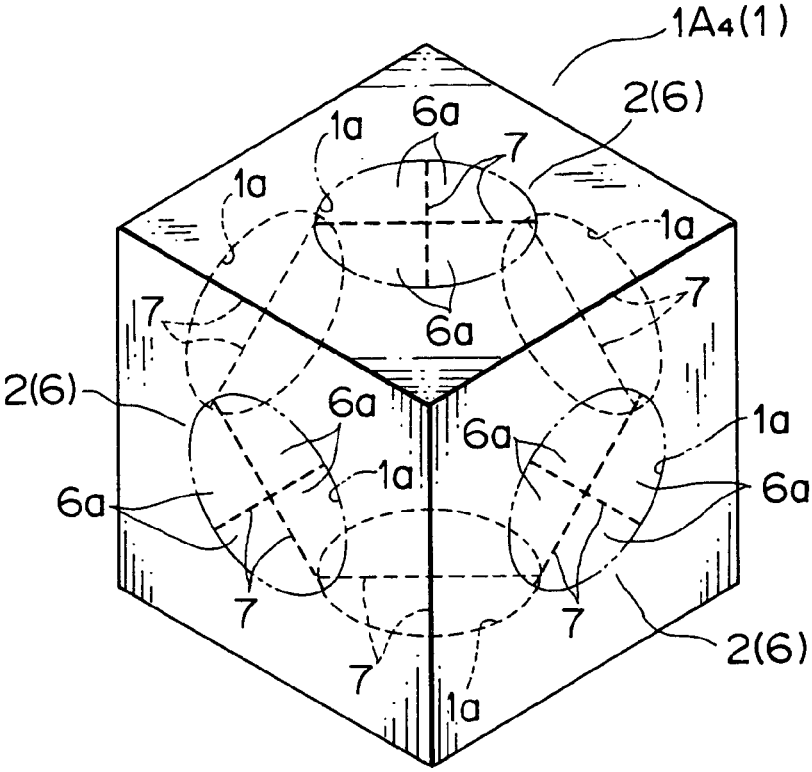
FIG. 18 is a perspective view showing a fifth modified expansive filler joint according to the present invention.
Figure 19:
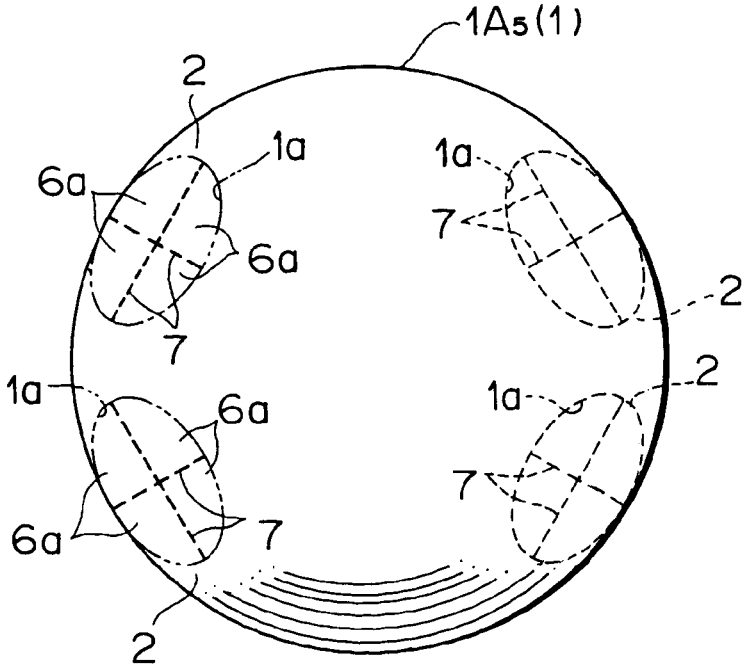
FIG. 19 is a perspective view showing a sixth modified expansive filler joint according to the present invention.

In each of the aforementioned embodiments, the securing hollow body 1 filled with the filler 4 employs a straight sleeve having two open ends as illustrated in FIG. 1. Although the sleeve is discussed as a best example, the securing hollow body 1 is not limited in the sleeve but may be any one of an L-shaped tube having two open ends as illustrated in FIG. 15, a tubular body 1A2 or 1A3 having three or four open ends as illustrated in FIG. 16 or 17, a box-shaped 1A4 as illustrated in FIG. 18, a generally cubic body 1A5 as illustrated in FIG. 19, and the like. Such configurations are within the present invention and are selectively employed to meet with application of the securing hollow body 1.

The culvert 20 and the L-shaped bulkhead blocks 30, 30' are discussed as specified examples of an expansive filler joint and a reinforcing bar jointing process using the expansive filler joint according to the present invention in FIGS. 7 to 9. However, a segmental concrete product K' according to the present invention is not limited in those having discussed above but may be a large-scale water channel block, a large-scale U-shaped channel block, a multi-purpose duct block, a manhole, a block for an underground water tank, a bulkhead block, a protection block for a building base, a bridge beam, other foundation blocks, etc.

INDUSTRIAL APPLICABILITY OF THE INVENTION

An expansive filler joint which includes:

a securing hollow body embedded in a jointing end of forming concrete or concrete segmental products, the securing hollow body made of a rigid material and having a closure means disposed at a plurality of side ends of the securing hollow body, an expansive filler filling the securing hollow body, and reinforcing bars inserted into the securing hollow body through the closure means and opposed to each other, wherein the opposed reinforcing bars are secured by prestress and pressure of expansion of the filler.

A reinforcing bar jointing process which includes:

embedding a securing hollow body in a jointing end of forming concrete or concrete segmental products, the securing hollow body made of a rigid material providing a closure means disposed on an opening formed at a side end of the securing hollow body, filling an expansive filler into the securing hollow body through the closure means, and inserting at least one of reinforcing bars opposed to each other into the securing hollow body through the closure means, wherein the reinforcing bars are secured to each other by prestress and pressure of expansion of the filler.

Thus, the reinforcing bars are efficiently joined to each other with a short time and less efforts. The sufficient bonding strength can join the reinforcing bars firmly secured with a shorter securing length of the reinforcing bars. A filled state of the filler can be easily monitored even when concrete segmental products are joined to each other, and the expansive filler joint is simple in construction to be low in manufacturing and material costs.

The present invention includes that the securing hollow body is defined in a straight pipe sleeve or an L-shaped tubular body, a tubular body having three or four end openings, a box, or a generally ball-shape body. Thus, the reinforcing bars are efficiently joined to each other with a short time and less efforts. The sufficient bonding strength can join the reinforcing bars firmly secured with a shorter securing length of the reinforcing bars. A filled state of the filler can be easily monitored even when the concrete segmental products are joined to each other, and the expansive filler joint is simple in construction to be low in manufacturing and material costs.

In claim 3 of the present invention, the securing hollow body has a thickness of about 3 to 15 mm. Thus, the expansion of the filler confined in the securing hollow body made of a rigid member provides most effectively a prestress effect and a pressure effect to surely secure the opposed reinforcing bars inserted into the securing hollow body.

In claim 4 of the present invention, the securing hollow body has an outer surface contacting a surrounding concrete and provided partially or totally with a membrane layer made of a flexible material. The membrane layer prevents cracking of the surrounding concrete due to the expansion, strain, tensile stress of the securing hollow body which are provided by the expansion pressure of the filler confined in the securing hollow body.

The filer includes calcium oxide of about 80.0 to 84.0 weight % as a major constituent, a heat generation retardant of about 1.0 to 2.0 weight %, silicon dioxide of about 8.0 to 9.0 weight %, aluminum oxide of about 2.0 to 2.3 weight %, and sulfur trioxide of about 4.0 to 4.5 weight %. The filler supplied in the securing hollow body includes the aluminum oxide which reacts with water to quickly surely expand the filler, achieving high consolidation, a high strength, and a high compressed structure. This provides an expanding filler having a larger bonding strength for the reinforcing bars with a low cost.

The closure means is a synthetic resin cap for closing an opening formed at a side end of the securing hollow body, and the cap may have a filling hole for introducing the filler. Since the cap has the filling hole formed in the cap, a predetermined quantity of the filler is surely filled into the securing hollow body with monitoring a filling state of the filler, so that the filler supplied in the securing hollow body does not leak from the securing hollow body 1 and expands to joint the reinforcing bars to each other.

The present invention includes that the cap of the closure means is provided with a suitable number of radially extending slits, and the filing hole is positioned near an upper periphery of the cap. Thus, the reinforcing bar is easily surely inserted into the securing hollow body via the closure means, and the filler supplied in the securing hollow body does not leak from the securing hollow body and expands to surely join the reinforcing bars to each other.

The present invention includes that the closure means has a generally annular sealing plate positioned in its rear side, the sealing plate being resilient for press-contacting an outer circumferential surface of a reinforcing bar inserted into the securing hollow body. Thus, the sealing plate positioned in the rear side of the cap works like a check valve, so that the filler supplied in the securing hollow body does not leak from the securing hollow body and expands to provide prestress and pressure to surely secure the reinforcing bar.

What is claimed is:

1. An expansive filler joint comprising:

a securing hollow body embedded in a jointing end of forming concrete or concrete segmental products, the securing hollow body made of a rigid material and having a closure means disposed at a plurality of side ends of the securing hollow body, an expansive filler filling the securing hollow body, and reinforcing bars inserted into the securing hollow body through the closure means and opposed to each other, wherein the filler includes calcium oxide as a major constituent and aluminum oxide as an expansion adjuvant, and the opposed reinforcing bars are secured by prestress and pressure of expansion of the filler.

2. The expansive filler joint according to claim 1, wherein the securing hollow body is defined in a straight pipe sleeve or an L-shaped tubular body, a tubular body having three or four end openings, a box, or a generally cubic body.

3. The expansive filler joint according to claim 1, wherein the securing hollow body has a thickness of about 3 to 15 mm.

4. The expansive filler joint according to claim 1, wherein the securing hollow body has an outer surface contacting surrounding concrete and provided partially or totally with a membrane layer made of a flexible material.

5. The expansive filler joint according to claim 1, wherein the filler includes calcium oxide of about 80.0 to 84.0 weight %, aluminum oxide of about 2.0 to 2.3 weight %, and sulfur trioxide of about 4.0 to 4.5 weight %.

6. The expansive filler joint according to claim 1, wherein the closure means is a synthetic resin cap for closing an opening formed at a side end of the securing hollow body, and the cap may have a filling hole for introducing the filler.

7. The expansive filler joint according to claim 6, wherein the cap of the closure means is provided with a suitable number of radially extending slits, and the filling hole is positioned near an upper periphery of the cap.

8. The expansive filler joint according to claim 1, wherein the closure means has a generally annular sealing plate positioned in its rear side, the sealing plate being resilient for press-contacting an outer circumferential surface of one of reinforcing bars inserted into the securing hollow body.

9. A reinforcing bar jointing process employing an expansive filler joint comprising:

embedding a securing hollow body in a jointing end of forming concrete or concrete segmental products, the securing hollow body made of a rigid material;

providing a closure means disposed on an opening formed at a side end of the securing hollow body;

filling an expansive filler into the securing hollow body through the closure means; and inserting a reinforcing bar into the securing hollow body through the closure means, wherein the filler includes calcium oxide as a major constituent and aluminum oxide as an expansion adjuvant, and the reinforcing bar is secured by prestress and pressure of expansion of the filler.

* * * * *